US007510630B2

(12) United States Patent
Zilker

(10) Patent No.: US 7,510,630 B2
(45) Date of Patent: Mar. 31, 2009

(54) EXTENDED COUCH NIP ON CYLINDER FORMER

(75) Inventor: Gregory D. Zilker, Brush Prairie, WA (US)

(73) Assignee: Albany International Corp., Albany, NY (US)

( * ) Notice: Subject to any disclaimer, the term of this patent is extended or adjusted under 35 U.S.C. 154(b) by 446 days.

(21) Appl. No.: 11/110,271

(22) Filed: Apr. 20, 2005

(65) Prior Publication Data

US 2006/0237157 A1 Oct. 26, 2006

(51) Int. Cl.
*D21F 11/06* (2006.01)
*D21F 1/60* (2006.01)

(52) U.S. Cl. ..... 162/210; 162/208; 162/318; 162/323; 162/358.3

(58) Field of Classification Search ..... 162/318–321, 162/323–335, 208, 210, 358.1, 358.3, 203, 162/214, 217; 100/121, 37
See application file for complete search history.

(56) References Cited

U.S. PATENT DOCUMENTS 2,200,002 A 5/1940 Lane et al.
3,224,928 A * 12/1965 Lee et al. ..... 162/214
3,397,112 A * 8/1968 Highton et al. ..... 162/318
3,554,866 A 1/1971 Wynstra
3,729,376 A * 4/1973 Stevens ..... 162/306
4,004,968 A * 1/1977 Braun et al. ..... 162/304
4,308,097 A 12/1981 Schiel
4,414,061 A 11/1983 Trufitt et al.
4,568,423 A * 2/1986 Laapotti ..... 162/358.3
4,880,500 A 11/1989 Eldridge et al.
4,919,760 A 4/1990 Kerttula
5,480,520 A * 1/1996 Esslinger ..... 162/301
5,647,958 A * 7/1997 Schmidt-Rohr et al. ..... 162/203
5,695,612 A 12/1997 Holopainen
6,235,158 B1 * 5/2001 Dahl et al. ..... 162/203
6,303,003 B1 * 10/2001 Webster ..... 162/290
6,447,642 B1 9/2002 Phan et al.
6,824,715 B2 11/2004 Cottier et al.

FOREIGN PATENT DOCUMENTS

DE 101 01 549 * 7/2002
WO WO 01/51703 A 7/2001

* cited by examiner

*Primary Examiner*—Eric Hug
(74) *Attorney, Agent, or Firm*—Frommer Lawrence & Haug, LLP; Ronald R. Santucci

(57) ABSTRACT

An apparatus for use in a cylinder machine having a shoe with a concavely-shaped pressure surface that forms a substantially mating relationship with a cylinder mould or sieve. The concavely-shaped pressure surface of the shoe increases the amount of wrap that a making fabric has on a cylinder mould or sieve thereby increasing the amount of friction generated between the making fabric and the cylinder mould or sieve. The increased friction results in an improved torque transfer between the making fabric and the cylinder mould or sieve.

35 Claims, 5 Drawing Sheets

EXTENDED COUCH NIP ON CYLINDER FORMER

BACKGROUND OF THE INVENTION

1. Field of the Invention

The present invention relates generally to cylinder formers in papermaking machines and other industrial applications such as fiber cement (FC) production and more specifically to an extended couch nip with a pressure shoe in the forming section of a cylinder mould that replaces the traditional couch roll to more effectively transmit torque from a making fabric to a cylinder mould or sieve.

2. Background of the Invention

Typically, during the process for making paper products such as but not limited to paper, paper board and carton board, a cellulosic fibrous web is formed by depositing a fibrous slurry, that is, an aqueous dispersion of cellulose fibers, onto a moving forming fabric in the forming section of a papermaking machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is sequentially directed in a serpentine path around each in the series of drums by a dryer fabric, which holds the paper sheet closely against the surfaces of the drums. The heated drums reduce the water content of the paper sheet to a desirable level through evaporation.

Presently, there are numerous ways of forming a continuous sheet of paper, paper board, and carton board. For example, continuous paper sheets, can be formed using a number of separate forming sections. The capital cost required to install a multi-fourdrinier papermaking machine, however, is high and sometimes the change is not feasible because of the total capital required. Additionally, larger space requirements are required for this type of papermaking machine. Another factor to consider in choosing which forming process to use may be the weight of the board to be produced or the properties of the board to be developed. Accordingly, in certain applications, the use of a cylinder mould in formation is desirable.

The principle of sheet formation using a cylinder former is depicted in FIG. 1 and is as follows. A horizontal cylinder (cylinder mould or sieve) 14 having a woven fabric sleeve is arranged to rotate approximately three quarters submerged in a container (vat) 22 of paper or other stock 20 so that a small arc of the cylinder's circumference is above stock level. Stock in this case is defined as a fibrous suspension and water. The fiber can be cellulose, synthetic or natural. Other additives such as inorganic particles necessary for development of product properties may also be present. Water 21 associated with the fibrous suspension drains through the woven fabric sleeve, resulting in a layer of fibers deposited on the surface of the fabric sleeve. Drainage takes place because of a difference in the water levels between the stock in the vat 22 and the backwater 23 inside the mould 14. The difference is known as the making head.

A moving fabric or "making fabric" 16 is then pressed by means of a couch roll 12 into contact with the cylinder mould 14 at approximately its top position. By doing this, a layer of fibers (fibrous web or fibrous suspension) that has formed on the fabric sleeve is transferred or couched to the making fabric 16 and moves away from the fabric sleeve with the fabric 16. The fibrous layer 18 formed on the fabric sleeve is transferred to the making fabric 16 upon contact by virtue of the fact that the making fabric 16 is less porous and smoother than the fabric sleeve, as a consequence of which atmospheric pressure facilitates the transfer. As the couch roll 12 compresses the making fabric 16 against the fabric sleeve on the cylinder mould or sieve 14, the making fabric 16 is performing multiple tasks. The fabric 16 is picking the wet fibrous web layer 18 off the sleeve surface on the cylinder mould 14, The making fabric 16 also acts as a drive belt for the entire forming/press section. Finally, the making fabric partially dewaters the fibrous web layer(s) by providing void volume or receptacles within the fabric for the water to go that is pressed out or removed by vacuum from the fibrous layer(s). Since a cylinder mould 14 is typically not connected to a driving means, the making fabric 16 is the source of rotation for the cylinder mould 14. Once the fibrous web 18 has been transferred to the making fabric 16, the sleeves of the cylinder mould 14 are washed by sprays and any fibrous material not transferred to the making fabric 16 enters into the fiber stock reservoir 20 for use in forming a new layer 18.

As depicted in FIG. 2, a number of these units can be placed in series resulting in a multi-cylinder machine. In a multi-cylinder machine, a multi-ply web or sheet is produced continuously. Each forming unit typically has its own supply of stock and a method of removing the drainage water from its interior so that, in effect, each cylinder mould is a separate web forming unit in itself. As the making fabric passes through successive units, additional layers of fibers are transferred or couched to the fibrous web that is already adhered to the making fabric.

Cylinder mould formation of the type described above may also be used in fiber cement (FC) board production. In the FC industry, cylinder mould formation is known as the "Hatscheck" process. In this process, a cementitious slurry is initially formed from water, cellulose fiber, silica, cement and other additives selected to impart particular properties to the product according to its intended application. Similarly to papermaking, a sieve cylinder or mould is immersed into a vat that contains the slurry. The cylinder rotates as it is progressively driven by the bottom run of a making fabric. As the making fabric passes over the cylinder and contacts the mesh screen of the cylinder, the layer of fiber formed on the screen is transferred to the making fabric. As in papermaking, a number of these units can be placed in series resulting in a multi-cylinder machine. This process can be applied to make numerous types of FC products used in the construction industry such as but not limited to FC board and FC pipe.

Various types of cylinder moulds and vat arrangements currently exist. In this regard, one typical cylinder mould is constructed around a cast iron core upon which is secured supporting spokes known as spiders. The spiders support concentric rims, the outside peripherals of which are grooved in order to carry rods that are approximately 1 centimeter in diameter and approximately 3.5 centimeters apart, parallel with the axis of the central shaft. A continuous wire is wound around the cylinder. This skeleton is traditionally covered with a stainless steel wire, typically in the 30-mesh to 50-mesh range. Synthetic sleeves, often made of polyethylene (PE), polyvinylidene fluoride (KYNAR®) and polyphenylene sulfide (RYTON®, PPS), etc., are typically woven and installed onto the cylinder mould or sieve in order to increase the fiber support as well as control formation by controlling drainage. The properties and weave patterns of the synthetic sleeves, however, can make it difficult for the making fabric to drive the cylinder mould due to a reduced friction between the mould and the fabric. The ability of the fabric to transmit torque to the mould, which results in rotation of the mould, is affected by tension (pressure from the couch roll) and the amount of contact between the couch roll and the mould, both of which affect the amount of friction between the two. Therefore, an improved means is needed to increase friction and effectively transfer torque from the making fabric to the cylinder mould in order to drive all the cylinder moulds.

Although, as previously stated, various types of cylinder moulds and vat arrangements exist, they will not be discussed in detail since the present invention can be equally applied to the various cylinder moulds and vat arrangements.

Prior devices have not been developed to increase the ability of the making fabric to drive a cylinder mould or sieve in a cylinder former. For example, U.S. Pat. No. 5,695,612 discloses a prepress for a paper web in a papermaking machine that uses a pressure shoe in conjunction with a backing element to apply a pressure to a paper web. The web passes between the load shoe and the backing element and is preferably positioned between two wires or fabrics. A medium is used to apply pressure to the load shoe to remove water from the paper web. The medium can also be passed through channels in the load shoe to lubricate the front surface of the load shoe's web plate. Here, the load shoe is not used in conjunction with a cylinder mould or sieve. The load shoe's function is not to increase the friction between a making fabric and a cylinder mould thereby increasing the making fabric's ability to drive a cylinder mould or sieve in a cylinder former.

Similarly, PCT Publication No. WO 01/51703 discloses a method and device for prepressing a paper web during web formation. A web of paper or a paper board is sandwiched between a pair of forming wires. In various embodiments, the sandwich of forming wires and paper web then passes through one or more pressure nips where the pressure nips may be one or more roll nips or an extended nip press which has a pressure shoe to press the web along a portion of the length of the web. Again, the pressure shoe in this instance does not increase the friction between a making fabric and a cylinder mould thereby enhancing the ability of the fabric to drive the cylinder mould in a cylinder former.

U.S. Pat. No. 4,308,097 discloses a paper web former for producing a paper web of fibrous suspension on a wire. The former comprises a convex shoe with an opening through which the pulp suspension exits onto a sliding surface of the shoe. The configuration that uses this former still uses couching rolls to press out the webs and couch them to a conveying (making) fabric. The former does not replace the couch roll and is not in a "nipping" relationship (where the shoe in conjunction with a backing element applies pressure to the fibrous web) with a cylinder mould.

In U.S. Pat. No. 4,880,500, a papermaking machine is modified by replacing a conventional rotatable couch roll with a stationary couching device. The stationary couching device has a member with a convexly curved and slotted upper surface on which the web slides. The convexly curved couching device is not in a "nipping" relationship with a cylindrical mould so the device is not used to increase friction and transfer torque from a making fabric to a cylinder mould in order to rotate the mould.

Lastly, U.S. Pat. No. 4,919,760 discloses a web former for a paper machine having a top wire and a lower wire. A forming shoe is fitted inside the lower wire loop and after a first forming roll in the web run direction, and guides the twin-wire dewatering zone part. The forming shoe has a convexly curved deck for guiding the lower wire loop. The forming shoe's placement in the paper machine facilitates water removal and water collection from the web without suction. Instead, water is collected and removed on the basis of kinetic energy, and partially on the basis of gravity. The forming shoe having a convexly curved deck is not in a "nipping" relationship with a cylindrical mould. Therefore, the device is not used to increase friction and transfer torque from a pick-up fabric to a cylinder mould in order to rotate the mould.

Accordingly, a need exists for an extended couch nip having a pressure shoe for use on a cylinder former, that increases the nip to a greater area of the making fabric so as to improve the ability of the fabric to drive the cylinder mould(s) or sieve(s) by increasing friction between the two.

SUMMARY OF THE INVENTION

It is an object of the present invention to provide an extended couch nip on a cylinder former in order to increase the amount of wrap a making fabric has on a cylinder mould in a cylinder mould machine, thereby more effectively transferring torque from the making fabric to the cylinder mould.

The present invention is directed to an apparatus for use in a cylinder mould machine. A shoe is provided having a concavely-shaped pressure surface that forms a mating relationship with a cylinder mould or sieve. The concavely-shaped pressure surface increases the amount of wrap that a making fabric has on a cylinder mould or sieve thereby increasing the amount of friction generated between the making fabric and cylinder mould or sieve. The increased friction results in increased torque transfer. The apparatus further comprises a loading means to increase or decrease the pressure on the shoe and a means for adjusting the pressure on a desired portion of the shoe.

Another aspect of the present invention is a method for increasing the amount of wrap a making fabric has on a cylinder mould or sieve. The method comprises providing a shoe having a concavely-shaped pressure surface that forms a mating relationship with a cylinder mould or sieve and increases the amount of wrap a making fabric has on the cylinder mould or sieve. The increased fabric wrap results in an increased friction generated between the making fabric and the cylinder mould or sieve. Increased friction results in increased torque transfer. The method further comprises providing pressure to the pressure shoe in order for the making fabric to drive the cylinder mould or sieve.

The various features of novelty which characterize the invention are pointed out in particularity in the claims annexed to and forming a part of this disclosure. For a better understanding of the invention, its operating advantages and specific objects attained by its uses, reference is made to the accompanying descriptive matter in which preferred embodiments of the invention are illustrated in the accompanying drawings in which corresponding components are identified by the same reference numerals.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF THE PREFERRED EMBODIMENTS

Figure 1:
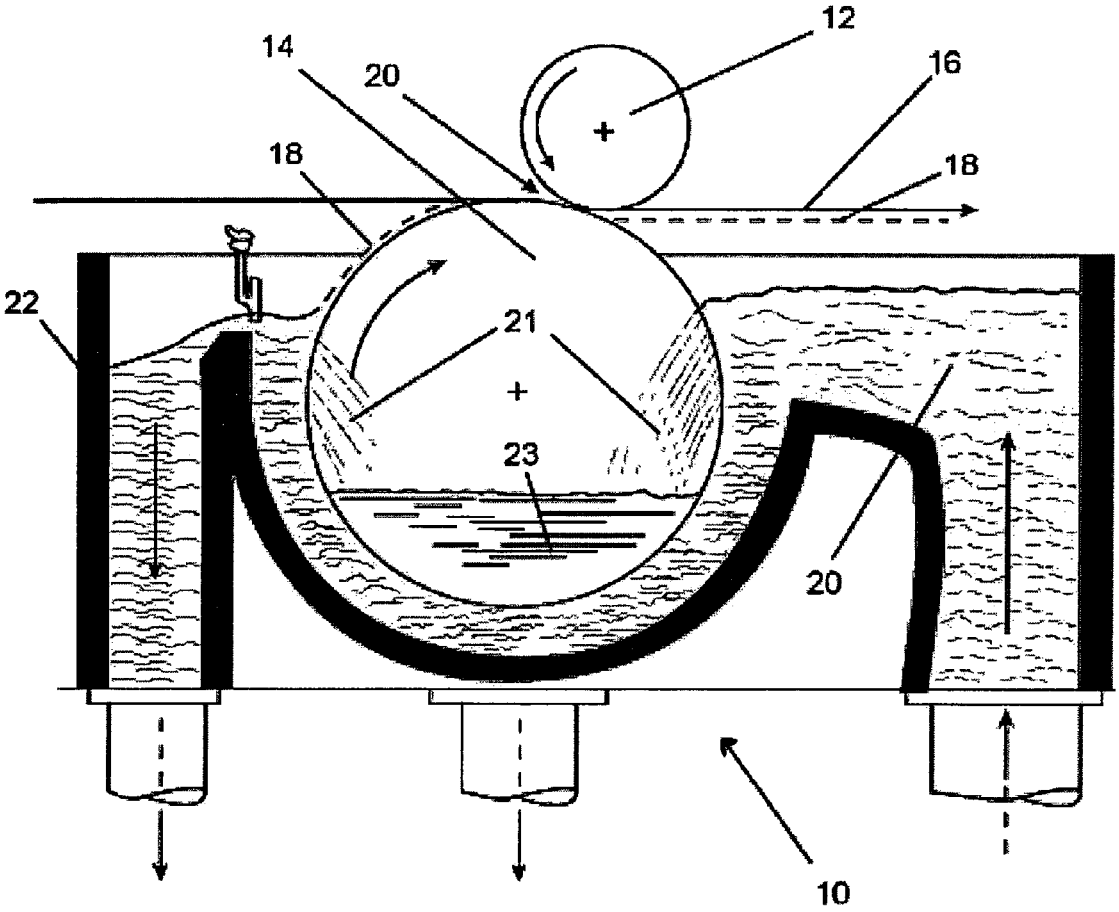
FIG. 1 (PRIOR ART)
FIG. 1 is a cross-sectional view of a conventional cylinder former utilizing a traditional soft rubber couch roll.
Figure 2:
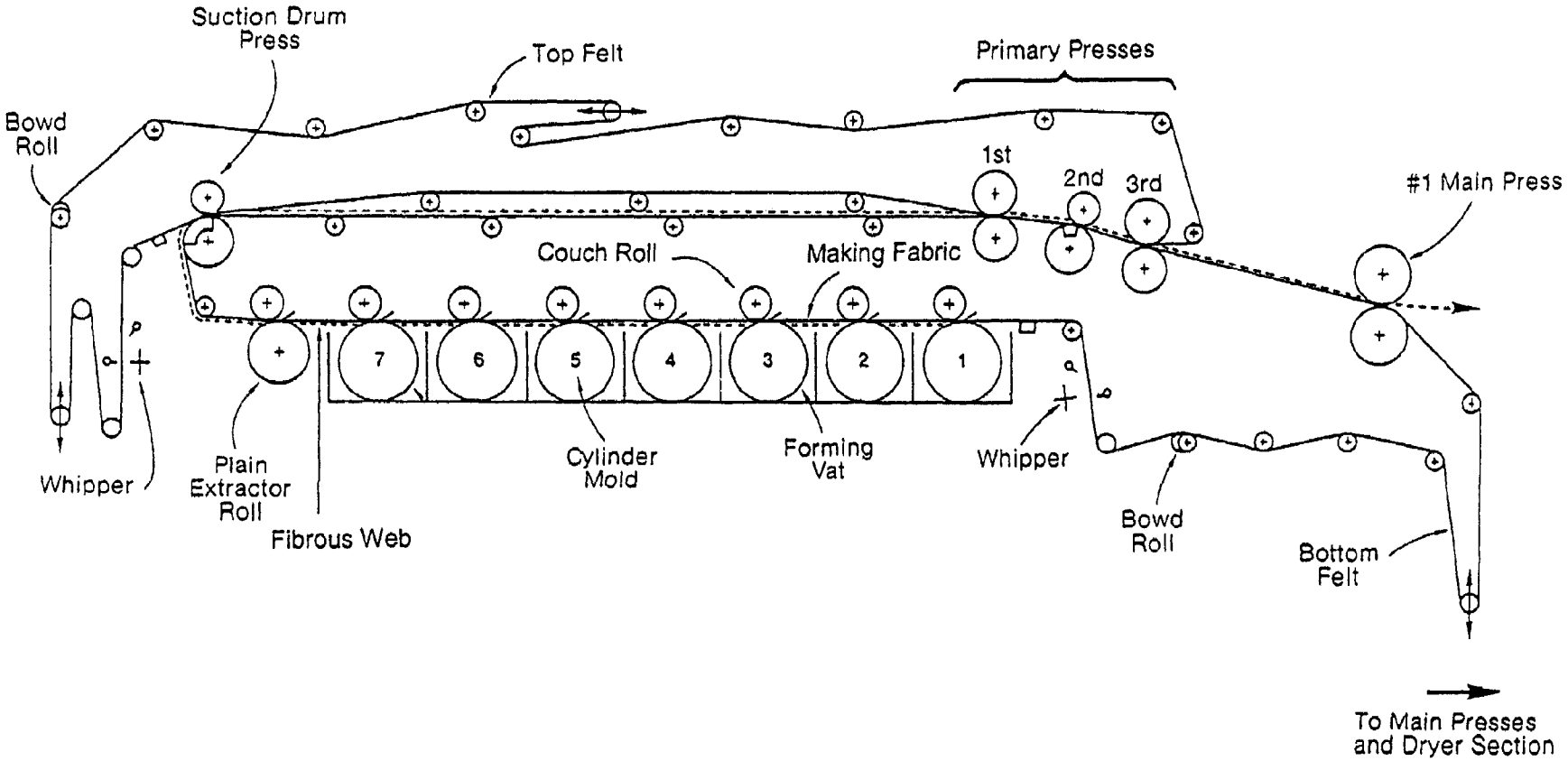
FIG. 2 is a cross-sectional view of a multi cylinder machine.

The present invention relates to an extended couch nip having a pressure shoe that replaces the conventional couch roll on a cylinder mould of a cylinder mould machine. Possible applications for the present invention include the production of paper products such as but not limited to paper, paper board and carton board. The present invention may also be used to produce fiber cement (FC) products such as but not limited to FC board or pipe.

In the following description, like reference characters designate like or corresponding parts throughout the figures. In the figures, arrows indicate the direction of rotation of the elements as well as indicate the direction of travel of the making fabric 16 that is from left to right.

As used herein, cylinder mould is synonymous with sieve and mould; making fabric is synonymous with fabric and press fabric; fibrous web is synonymous with web; and pressure shoe is synonymous with shoe.

Figure 3:
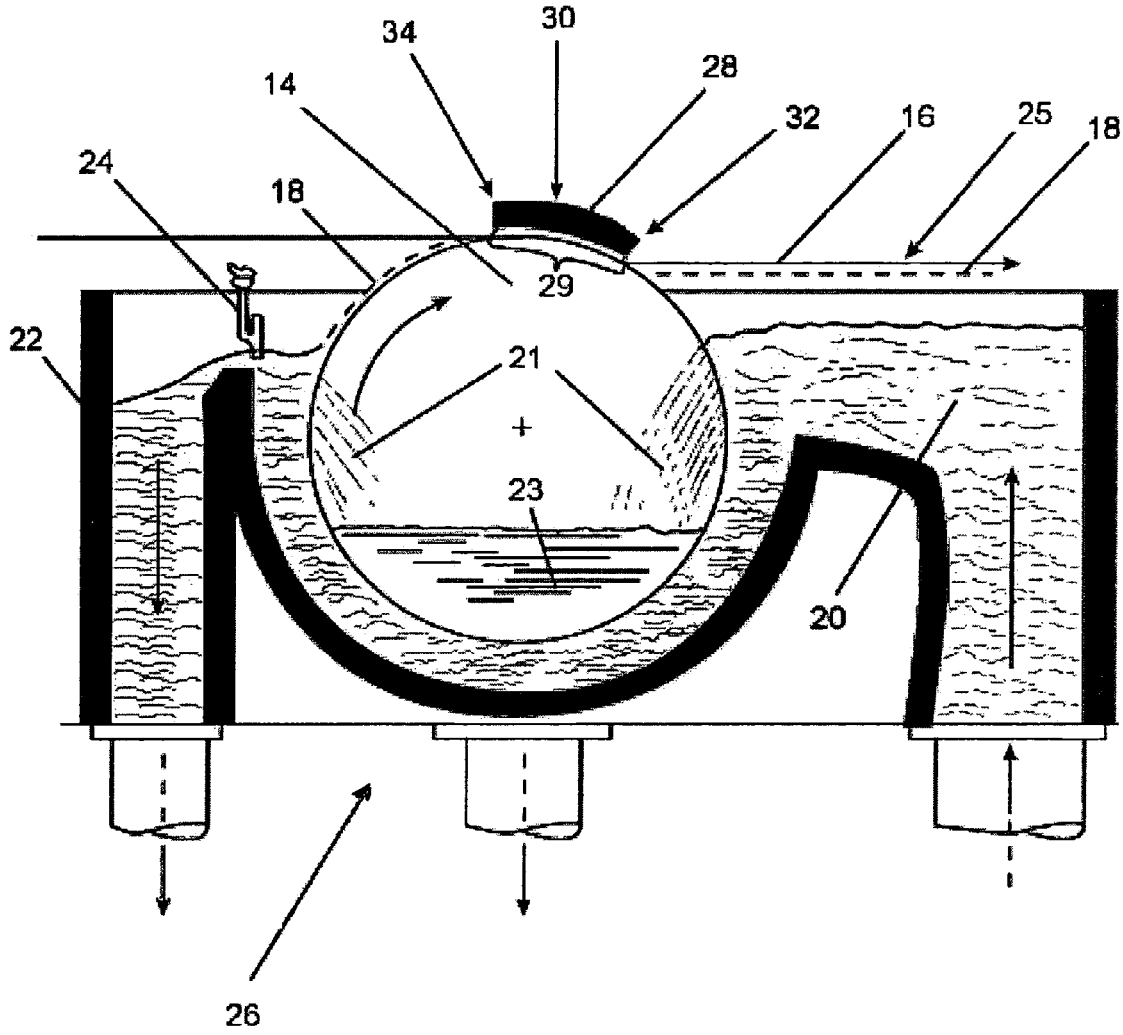
FIG. 3 is a cross-sectional view of a cylinder former with an extended couch nip having a pressure shoe according to one embodiment of the present invention.

FIG. 1 depicts a conventional cylinder mould machine 10 used for forming a fibrous web using a traditional soft rubber couch roll 12. FIG. 3 depicts a cylinder mould machine 26 with the traditional couch roll replaced with an extended couch nip having a pressure shoe 28. Replacing the couch roll 12 with an extended couch nip having a pressure shoe 28 increases the area of the pressure surface 29 (concave surface) in contact with a making fabric 16. By increasing the pressure surface 29 in contact with a making fabric 16, the amount of wrap the making fabric 16 has on a cylinder mould or sieve 14 is increased and hence more torque and more driving force can be transmitted from the making fabric 16 to the cylinder mould 14.

In FIG. 1, the contact area between the couch roll 12, making fabric 16 and cylinder mould 14 occurs at the couch nip 20 over a small, discrete region. As the making fabric 16 travels through the couch nip 20 and pressure is applied by the couch roll 12, torque is transferred from the making fabric 16 to the cylinder mould 14 resulting in rotation of the cylinder mould 14. The addition of synthetic sleeves on the cylinder mould 14 in conjunction with the small area of contact between the making fabric 16 and the cylinder mould 14, however, results in reduced friction, making it difficult for the making fabric 16 to drive (rotate) the mould 14.

The extended couch nip pressure shoe 28 in FIG. 3 has a concavely-shaped pressure surface 29 so as to form a mating relationship with the cylinder mould 14. The concave shape of the pressure surface 29 increases the area of the making fabric 16 in contact with the cylinder mould 14 by increasing the amount of wrap the making fabric 16 has on the cylinder mould 14. This increased wrap results in increased friction between the cylinder mould 14 and the making fabric 16 and an increased ability of the fabric 16 to drive (rotate) the mould 14. Additionally, dewatering of the fibrous web 18 is improved due to the increased area of the pressure surface 29 in contact with the making fabric 16 and the extended period of time that the fibrous web 18 and the making fabric 16 are in contact.

The amount of wrap that the making fabric 16 has on the cylinder mould 14 is affected in two ways: 1) the size of the pressure shoe's 28 pressure surface 29 in contact with the making fabric 16; and 2) the circumferential positioning of the pressure shoe 28 in relation to the cylinder mould 14. Hence, a larger pressure surface 29 in contact with the making fabric 16 results in increased making fabric 16 wrap and increased friction on the mould 14. A smaller pressure surface 29 in contact with the making fabric 16 results in decreased making fabric 16 wrap and decreased friction between the mould 14 and the fabric 16.

Figure 4:
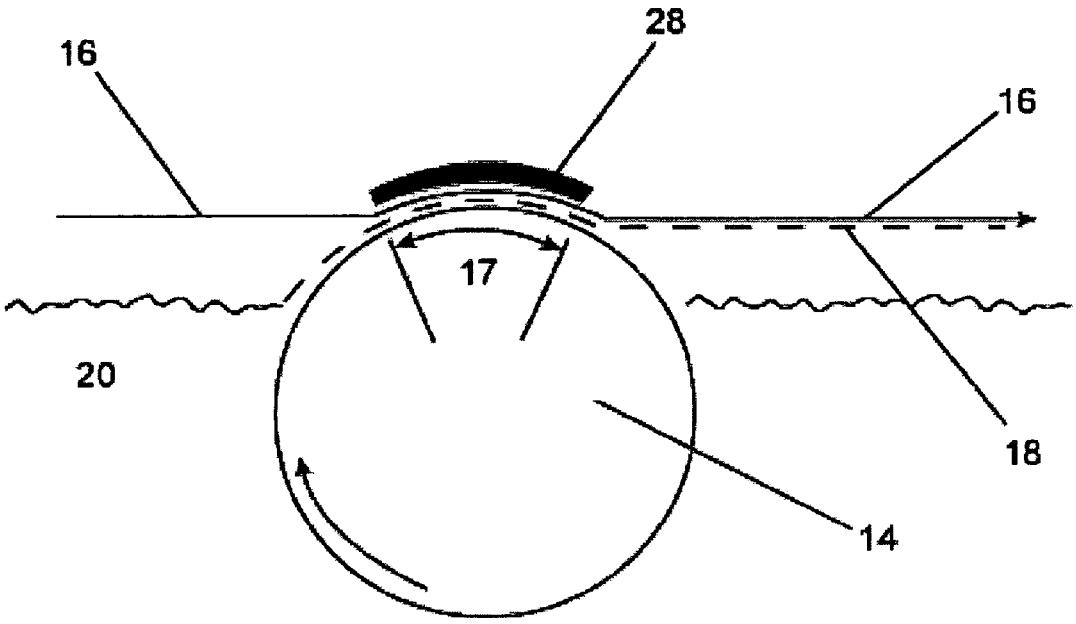
FIG. 4 is a cross sectional view depicting a placement of a pressure shoe on a cylinder former according to one embodiment of the present invention.
Figure 5:
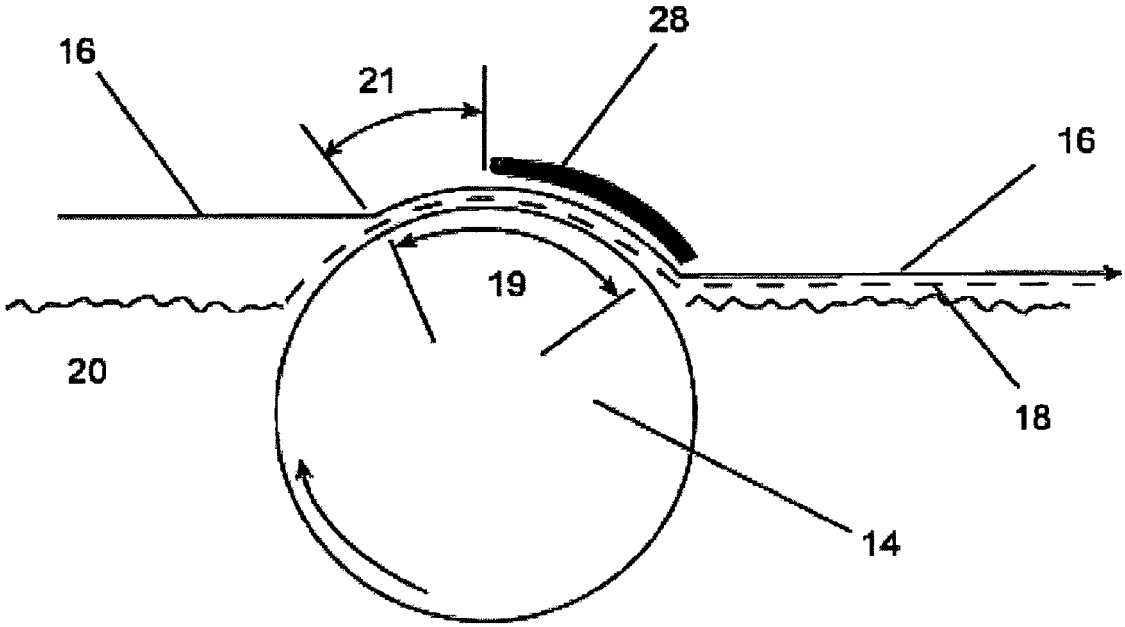
FIG. 5 is a cross sectional view depicting another placement of a pressure shoe on a cylinder former according to one embodiment of the present invention.

Making fabric 16 wrap and friction, however, can also be affected by the circumferential positioning of the pressure shoe 28 in relation to the cylinder mould 14. For example, according to one embodiment of the present invention, the pressure shoe 28 is positioned high on the cylinder mould 14 as depicted in FIG. 4. In this configuration, the amount of making fabric wrap 17 on the cylinder mould 14 is equal to the area of the pressure surface 29 in contact with the mould 14. But, the lower down on the cylinder mould 14 in the direction of rotation that the pressure shoe 28 is placed also affects making fabric 16 wrap. In FIG. 5, which depicts another aspect of the present invention, the pressure shoe 28 is positioned lower down on the cylinder mould 14 in the direction of rotation. This configuration causes portions 21 of the making fabric 16 not in contact with the pressure surface 29 to wrap around the cylinder mould 14 resulted in increased making fabric wrap 19. Again, the increased wrap of the making fabric 16 increases the friction between the making fabric 16 and the cylinder mould 14 resulting in increased torque transfer and driving force.

Furthermore, the pressure shoe 28 is connected to a loading means 30 such as, but not limited to, pneumatics, hydraulics and/or springs, or any combination thereof, so that pressure can be applied to the pressure shoe 28 to increase the friction between the fabric 16 and the mould 14. The ability to increase or decrease the amount of pressure applied to the pressure shoe 28 allows the user to control the amount of friction generated between the fabric 16 and the cylinder mould 14 and therefore the amount of torque transferred between the fabric 16 and the mould 14. This results in the user having more control of the speed at which the cylinder mould 14 rotates. Additionally, the pressure shoe 28 can be articulating or otherwise adjustable so that the pressure applied to the shoe 28 can be adjustable on a desired portion of the shoe 28 such as the leading edge 32 and the trailing edge 34 of the pressure shoe 28.

Since the extended couch nip of the present invention affects friction and hence torque transfer between the making fabric 16 and cylinder mould 14 in different ways, the cylinder former can have numerous configurations. For example, increased friction can be achieved with a lower load applied when a larger pressure shoe 28 having a larger pressure surface area 29 in contact with the making fabric 16 is used. Alternatively, an increased friction between the fabric 16 and the cylinder mould 14 can also be achieved using a smaller pressure shoe 28 with a higher load applied or using a smaller shoe 28 that is positioned lower on the cylinder mould 14 in the direction of rotation as depicted in FIG. 5. Essentially, as will be apparent to the skilled artisan, a multitude of configurations that vary the size, position and/or pressure applied to the pressure shoe 28, can be used to achieve the desired amount of torque to be transferred.

Figure 6:
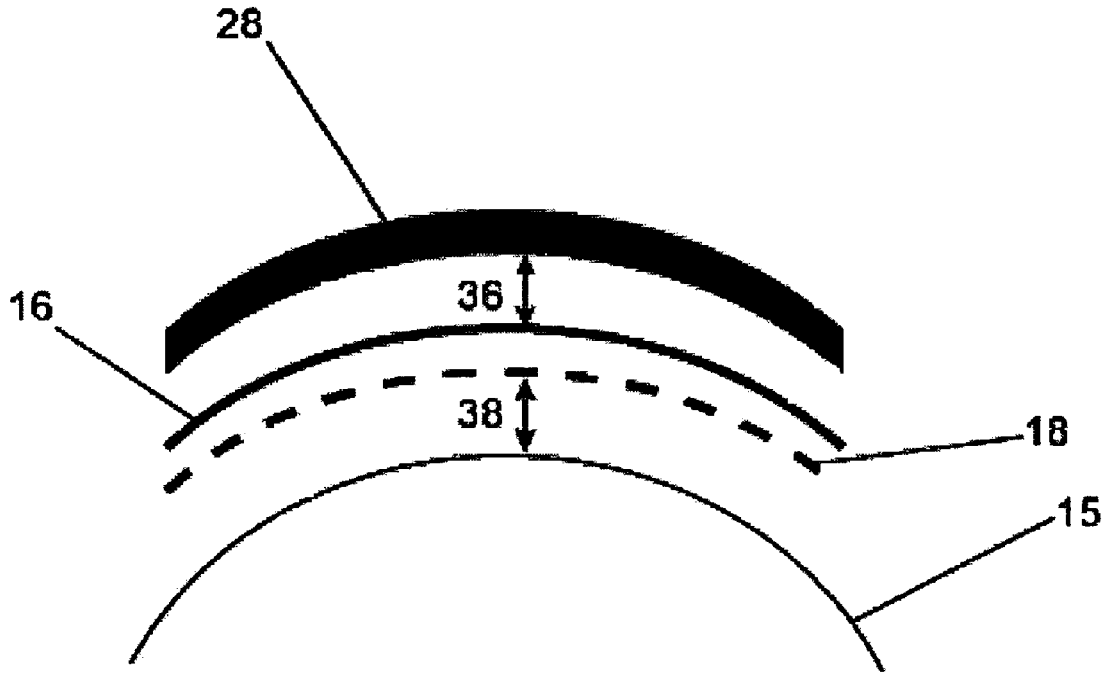
FIG. 6 is a magnified cross-sectional view of the sandwich configuration at the extended couch nip.

The pressure shoe 28 can be made of a dimensionally stable and abrasion resistant material such as, but not limited to zirconia oxide ceramic, metal with a polymer or inorganic surface or solid ceramic. Other materials suitable for the pressure shoe 28 will be apparent to the skilled artisan. The concavely-shaped pressure surface 29 of the shoe 28 in contact with the making fabric 16 is substantially smooth so that the shoe 28 is low in friction and non-abrasive to the non-fibrous web forming side 25 of the making fabric 16 and may be impervious to liquids. Essentially, as depicted in FIG. 6, there is a sandwich configuration at the extended couch nip that consists of the mould sleeve 15, fibrous layer 18, making fabric 16 and pressure shoe 28. There are two separate and independent frictional forces on each side of the making fabric 16. There is a frictional force 36 between the pressure shoe 28 and the making fabric 16 an a frictional force between the making fabric 16/fibrous layer 18 and the mould sleeve 15. Therefore, the decreased friction between the making fabric 16 and the pressure shoe 28 does not affect the making fabric's 16 ability to drive the cylinder mould 14. The reduced friction between the pressure shoe 28 and the making fabric 16 allows less mechanical energy to be used to drive the cylinder mould 14 since reduced friction results in less energy being converted to heat. Reduced friction also extends the making fabric's life because the pressure shoe's surface 29 is less abrasive and less destructive to the fabric 16.

Lastly, in any product that is formed of multiple wet layers by this method, consolidation of the sheet, such as strength, interlayer bond, etc. is important. Again, since the fibrous web 18 is under an applied pressure for a longer period of time, the value level of the desired product is increased.

Although preferred embodiments of the present invention and modifications thereof have been described in detail herein, it is to be understood that this invention is not limited thereby, and that other modifications and variations may be effected by one skilled in the art without departing from the spirit and scope of the invention as defined by the appended claims.

What is claimed is:

1. A cylinder mould apparatus for use in a cylinder machine, said apparatus comprising:

a shoe having a substantially concavely-shaped pressure surface forming a substantially mating relationship with a cylinder mould or sieve, wherein said concavely-shaped pressure surface increases an amount of wrap a making fabric has on said cylinder mould or sieve thereby increasing an amount of friction generated between said making fabric and said cylinder mould or sieve resulting in an increased torque transfer and increased driving force transmitted from said making fabric to said cylinder mould or sieve.

2. The apparatus of claim 1, wherein said substantially concavely-shaped pressure surface is constructed from a dimensionally stable and abrasion resistant material.

3. The apparatus of claim 2, wherein said dimensionally stable and abrasion resistant material is selected from the group consisting of zirconia oxide ceramic, metal with a polymer surface, metal with an inorganic surface and solid ceramic.

4. The apparatus of claim 1, wherein said substantially concavely-shaped pressure surface is substantially smooth.

5. The apparatus of claim 4, wherein said substantially smooth surface is impervious to liquids.

6. The apparatus of claim 4, wherein said substantially smooth surface is in contact with a making fabric.

7. The apparatus of claim 1, wherein said substantially concavely-shaped pressure surface has a greater surface area in contact with said making fabric when compared to that of a couch roll.

8. The apparatus of claim 1, further comprising:

a loading means for increasing or decreasing said pressure on said shoe; and a means for adjusting said pressure on a desired portion of said shoe.

9. The apparatus of claim 8, wherein said loading means is selected from the group consisting of pneumatics, hydraulics and springs.

10. The apparatus of claim 9, wherein said loading means can be any combination of said pneumatics, said hydraulics and said springs.

11. The apparatus of claim 8, wherein said pressure adjusting means is an articulating structure.

12. The apparatus of claim 8, wherein said desired portion is a leading edge of said shoe.

13. The apparatus of claim 8, wherein said desired portion is a trailing edge of said shoe.

14. The apparatus of claim 8, wherein an amount of pressure applied to said shoe corresponds to an amount of friction generated between said making fabric and said cylinder mould or sieve.

15. The apparatus of claim 14, wherein said friction corresponds to an amount of torque transferred from said making fabric to said cylinder mould or sieve.

16. The apparatus of claim 1, wherein said apparatus is used in said cylinder machine to produce paper, paper board, carton board, fiber cement board or fiber cement pipe.

17. A method for increasing the amount of torque transferred from a making fabric to a cylinder mould or sieve in a cylinder machine comprising the steps of:

providing a shoe having a concavely-shaped pressure surface forming a substantially mating relationship with said cylinder mould or sieve; and increasing an amount of wrap a making fabric has on said cylinder mould or sieve thereby increasing an amount of friction generated between said making fabric and said cylinder mould or sieve resulting in an increased torque transfer and increased driving force transmitted from said making fabric to said cylinder mould or sieve.

18. The method of claim 17 further comprising:

providing a loading means to increase or decrease said pressure on said shoe; and providing a means for adjusting said pressure on a desired portion of said shoe.

19. The method of claim 18, wherein a pressure is applied to said pressure shoe.

20. The method of claim 17, wherein said pressure surface has a greater surface area in contact with said making fabric when compared to a couch roll.

21. The method of claim 18, wherein said loading means is selected from the group consisting of pneumatics, hydraulics and springs.

22. The method of claim 21, wherein said loading means can be any combination of said pneumatics, said hydraulics and said springs.

23. The method of claim 18, wherein said pressure adjusting means is an articulating structure.

24. The method of claim 18, wherein said desired portion is a leading edge of said shoe.

25. The method of claim 18, wherein said desired portion is a trailing edge of said shoe.

26. The method of claim 18, wherein said method is used to increase the amount of torque transferred from a making fabric to a cylinder mould or sieve in the production of paper, paper board, carton board, fiber cement board or fiber cement pipe.

27. In a machine for producing paper products or fiber cement products having at least one making fabric and at least one cylinder mould or sieve, the improvement comprising:

a loaded shoe having a substantially concavely-shaped pressure surface located at a position on a face of the cylinder mould's outer circumference;

wherein said shoe increases an amount of wrap said making fabric has on said cylinder mould or sieve; and whereby the increased amount of wrap increases an amount of friction generated between said making fabric and said cylinder mould or sieve thereby increasing the torque transfer between said making fabric and said cylinder mould or sieve and increased driving force transmitted from said making fabric to said cylinder mould or sieve.

28. The apparatus of claim 27, wherein said substantially concavely-shaped pressure surface is constructed from a dimensionally stable and abrasion resistant material.

29. The apparatus of claim 27, wherein said substantially concavely-shaped pressure surface has a greater surface area in contact with said making fabric when compared to that of a couch roll.

30. The apparatus of claim 27, wherein said improvement further comprises:

a loading means for increasing or decreasing said pressure on said shoe; and a means for adjusting said pressure on a desired portion of said shoe.

31. The apparatus of claim 30, wherein said loading means is selected from the group consisting of pneumatics, hydraulics and springs.

32. The apparatus of claim 31, wherein said loading means can be any combination of said pneumatics, said hydraulics and said springs.

33. The apparatus of claim 30, wherein said pressure adjusting means is an articulating structure.

34. The apparatus of claim 30, wherein an amount of pressure applied to said shoe corresponds to an amount of friction generated between said making fabric and said cylinder mould or sieve.

35. The apparatus of claim 34, wherein said friction corresponds to an amount of torque transferred from said making fabric to said cylinder mould or sieve.

* * * * *